US006208593B1

(12) United States Patent
Liao

(10) Patent No.: US 6,208,593 B1
(45) Date of Patent: Mar. 27, 2001

(54) LUMINOUS BODY FOR A WATCH

(76) Inventor: Ching-Shin Liao, No. 467, Ta-Li Rd., Ta-Li City, Taichung Hsien (TW)

( * ) Notice: Subject to any disclaimer, the term of this patent is extended or adjusted under 35 U.S.C. 154(b) by 0 days.

(21) Appl. No.: 09/399,727

(22) Filed: Sep. 20, 1999

(51) Int. Cl.[7] ..... G04B 19/06
(52) U.S. Cl. ..... 368/232; 368/239; 368/228
(58) Field of Search ..... 368/227, 232, 368/237, 228–230, 239, 80, 83

(56) References Cited

U.S. PATENT DOCUMENTS 5,346,718 * 9/1994 Thorgersen et al. ..... 368/227
5,513,153 * 4/1996 Thorgersen et al. ..... 368/227
5,838,644 * 11/1998 Yoneda et al. ..... 368/232

* cited by examiner

*Primary Examiner*—Bernard Roskoski
(74) *Attorney, Agent, or Firm*—Bacon & Thomas, PLLC

(57) ABSTRACT

A luminous body mounted in a watch below hands and a protective crystal and controlled by a switch to produce light, the luminous body including an insulative layer sandwiched in between a first conductive layer and a second conductive layer, electroluminescent means arranged on the insulative layer for producing light upon electric connection of electricity to the first and second conductive layers, the electroluminescent means having a first electroluminescent layer formed of a plurality of electroluminescent indices respectively arranged on the insulative layer around the border area of the insulative layer and a second electroluminescent layer of annular shape arranged on the center area of the insulative layer, a plurality of marks covered on the electroluminescent indices of the first electroluminescent layer, and a light penetrable layer covered on the first conductive layer, the light penetrable layer having a plurality of raised portions corresponding the electroluminescent indices of the first electroluminescent layer for refracting light.

7 Claims, 5 Drawing Sheets

LUMINOUS BODY FOR A WATCH

BACKGROUND OF THE INVENTION

The present invention relates to watches, and more specifically to a luminous body for a watch.

Various watches with luminous means have been disclosed, and have appeared on the market. These watches commonly comprise an electroluminescent layer covered over the bottom surface of a transparent dial. When electrically connected, the electroluminescent layer is energized to produce light and, to illuminate the markers at the dial. Because the electroluminescent layer covers the whole area of the bottom surface of the dial, much electric energy is consumed during its operation.

SUMMARY OF THE INVENTION

According to one aspect of the present invention, the luminous body comprises an insulative layer sandwiched in between a first conductive layer and a second conductive layer, a light penetrable layer covered on the first conductive layers, electroluminescent means arranged on the insulative layer and energized to produce light upon electric connection of the first and second conductive layers to power source, and marks of Arabic numerals, Roman numerals, or the like marked on the electroluminescent means, wherein the electroluminescent means covers only a part of the insulative layer so that less electric energy is consumed during operation of the luminous body. According to another aspect of the present invention, the light penetrable layer has raised portions refracting light from the electroluminescent means. According to still another aspect of the present invention, the electroluminescent means is comprised of a first electroluminescent layer formed of a plurality of electroluminescent indices colored with different colors, and a second electroluminescent layer colored with a particular color. According to still another aspect of the present invention, switch means is provided for controlling power supply to the first and second conductive layers.

DETAILED DESCRIPTION OF THE PREFERRED EMBODIMENT

Figure 1:
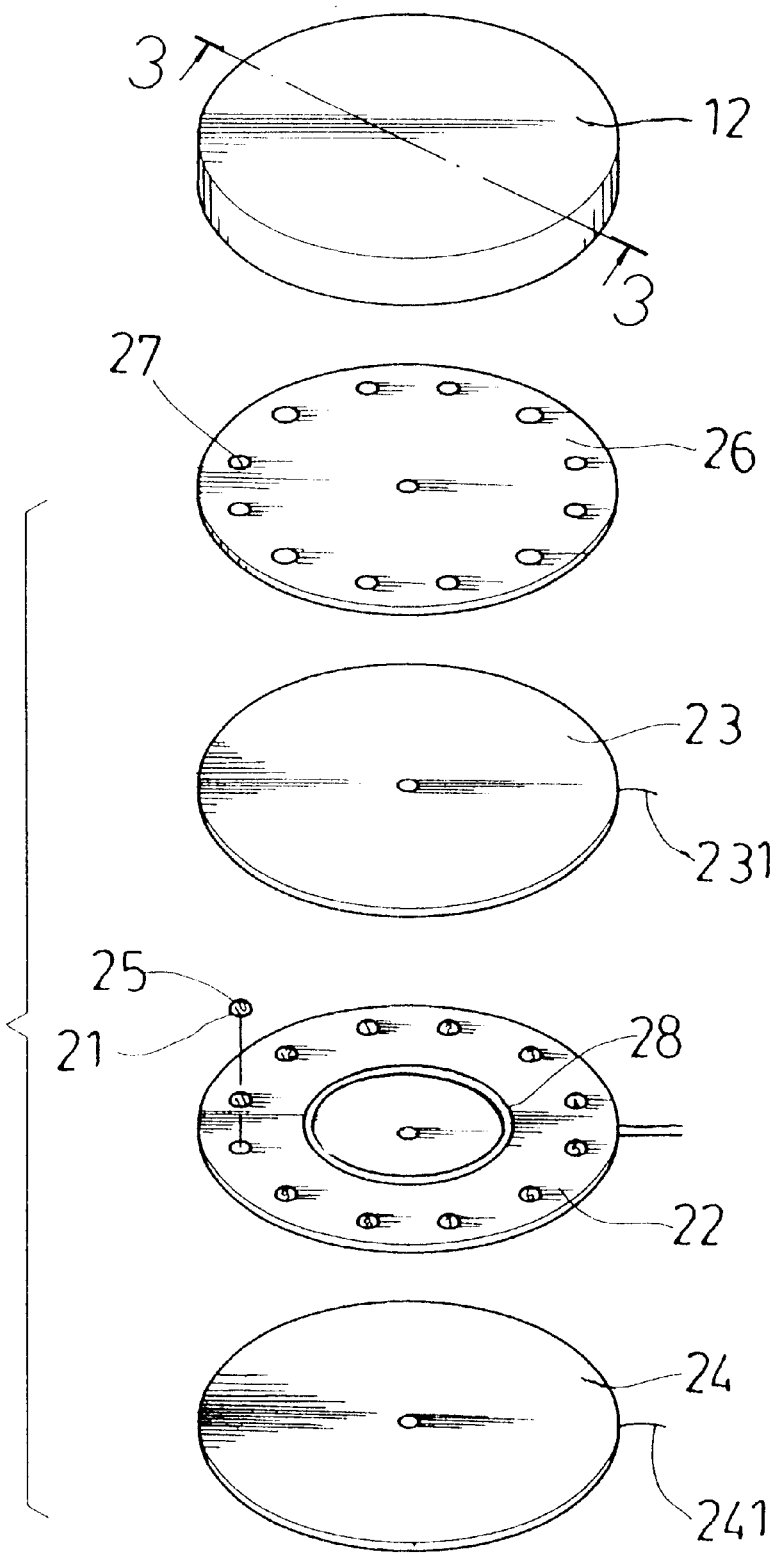
FIG. 1 is an exploded view of a luminous body for a watch according to the present invention.

Referring to Figures from 1 through 4, a watch 10 is shown comprising a protective crystal 12 at the top side, a luminous body 20 disposed below the protective crystal 12, hands 11 suspended between the protective crystal 12 and the luminous body 20 and respective turned to indicate time, and a switch 30 at the periphery for driving the luminous body 20 to produce light.

Figure 2:
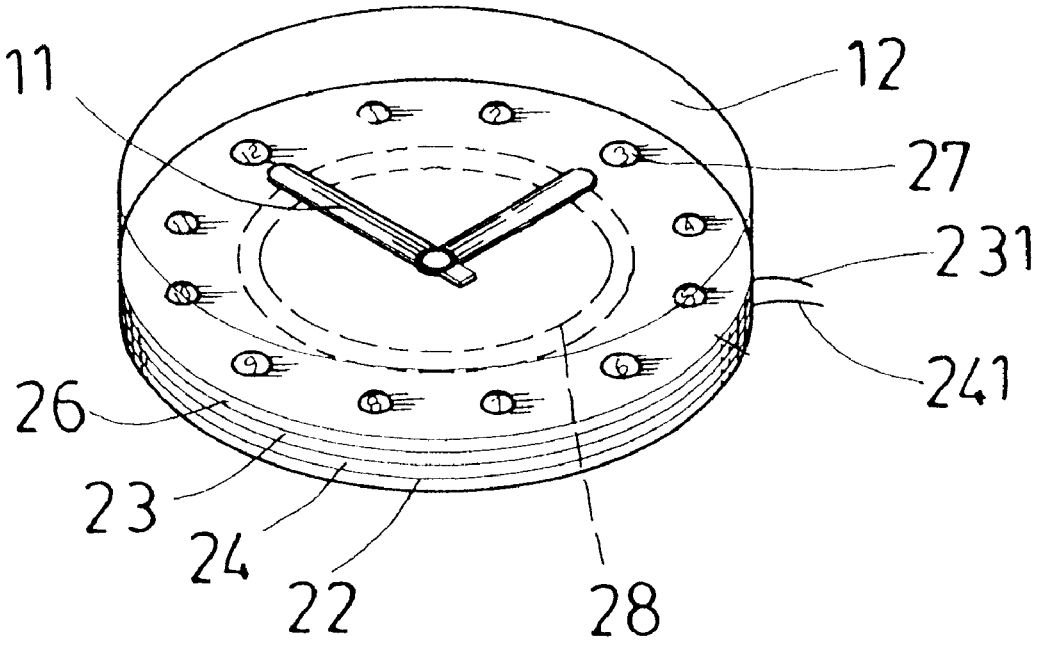
FIG. 2 is a perspective view of the present invention, showing the luminous body arranged below the hands and the crystal.
Figure 3:
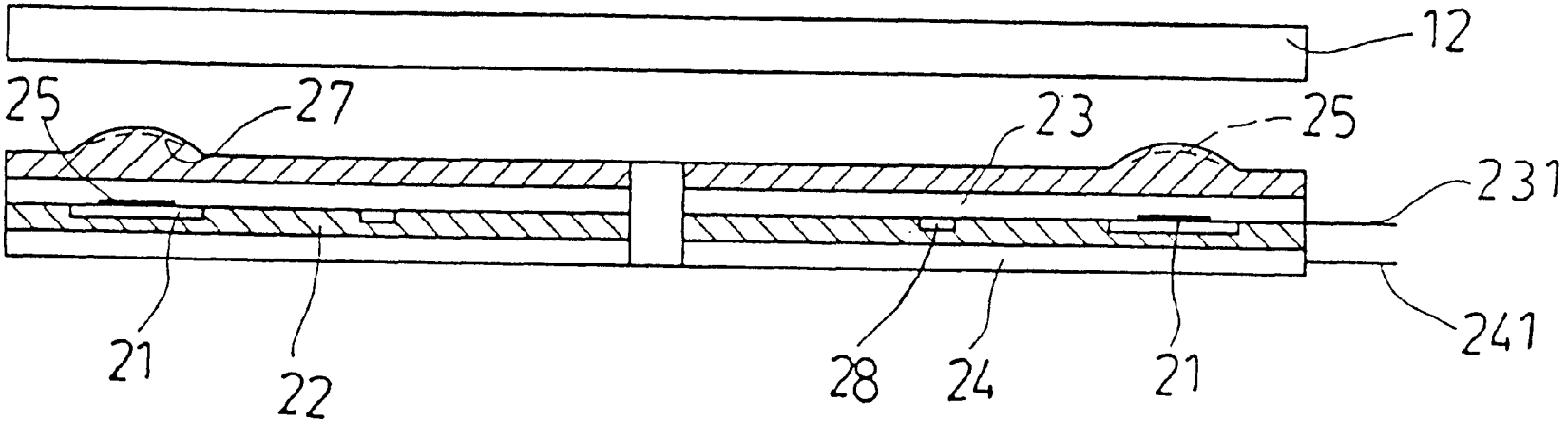
FIG. 3 is a sectional view in an enlarged scale taken along line 3—3 of FIG. 1.
Figure 4:
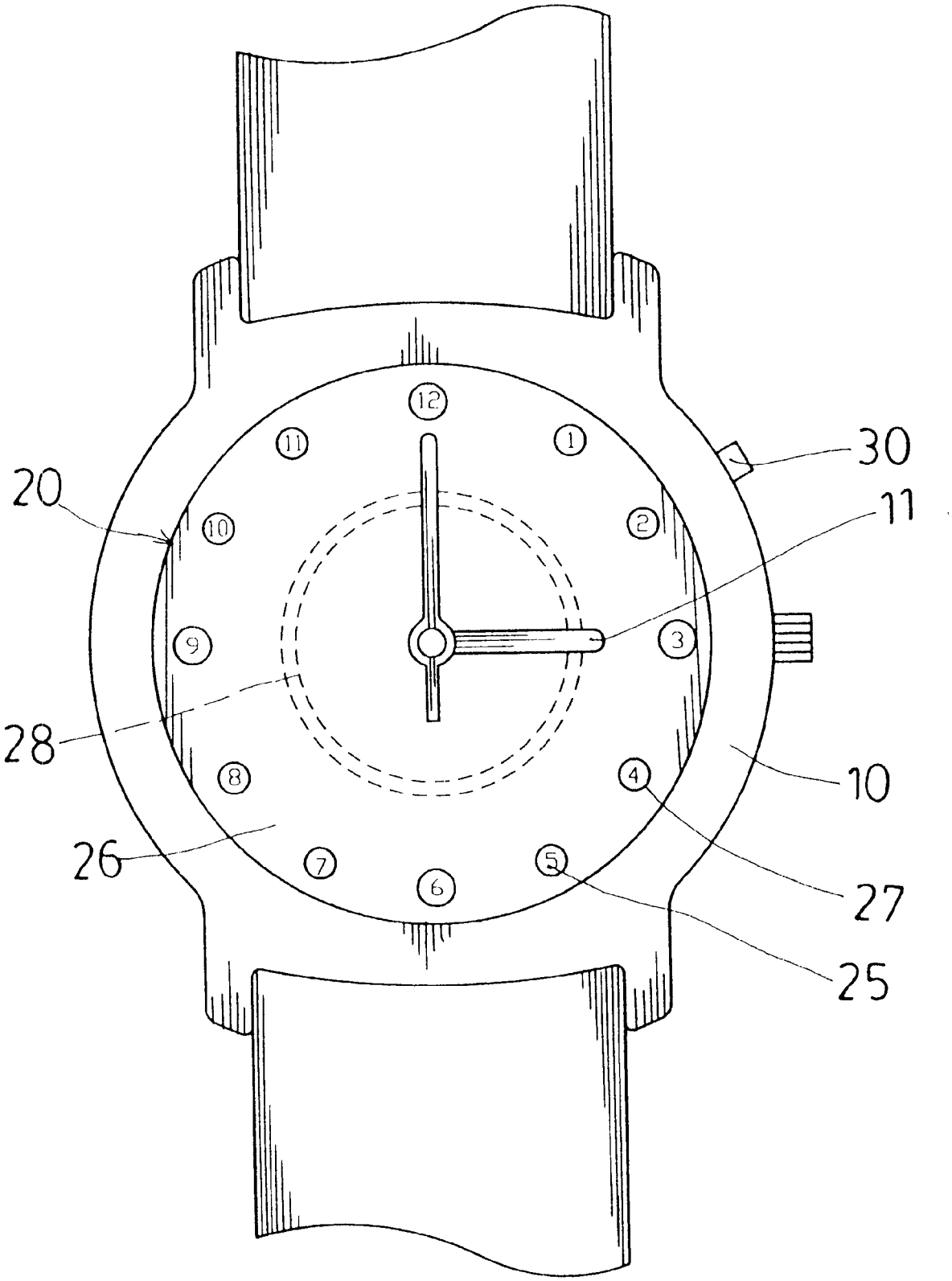
FIG. 4 is a plain view of a watch constructed according to the present invention.
Figure 5:
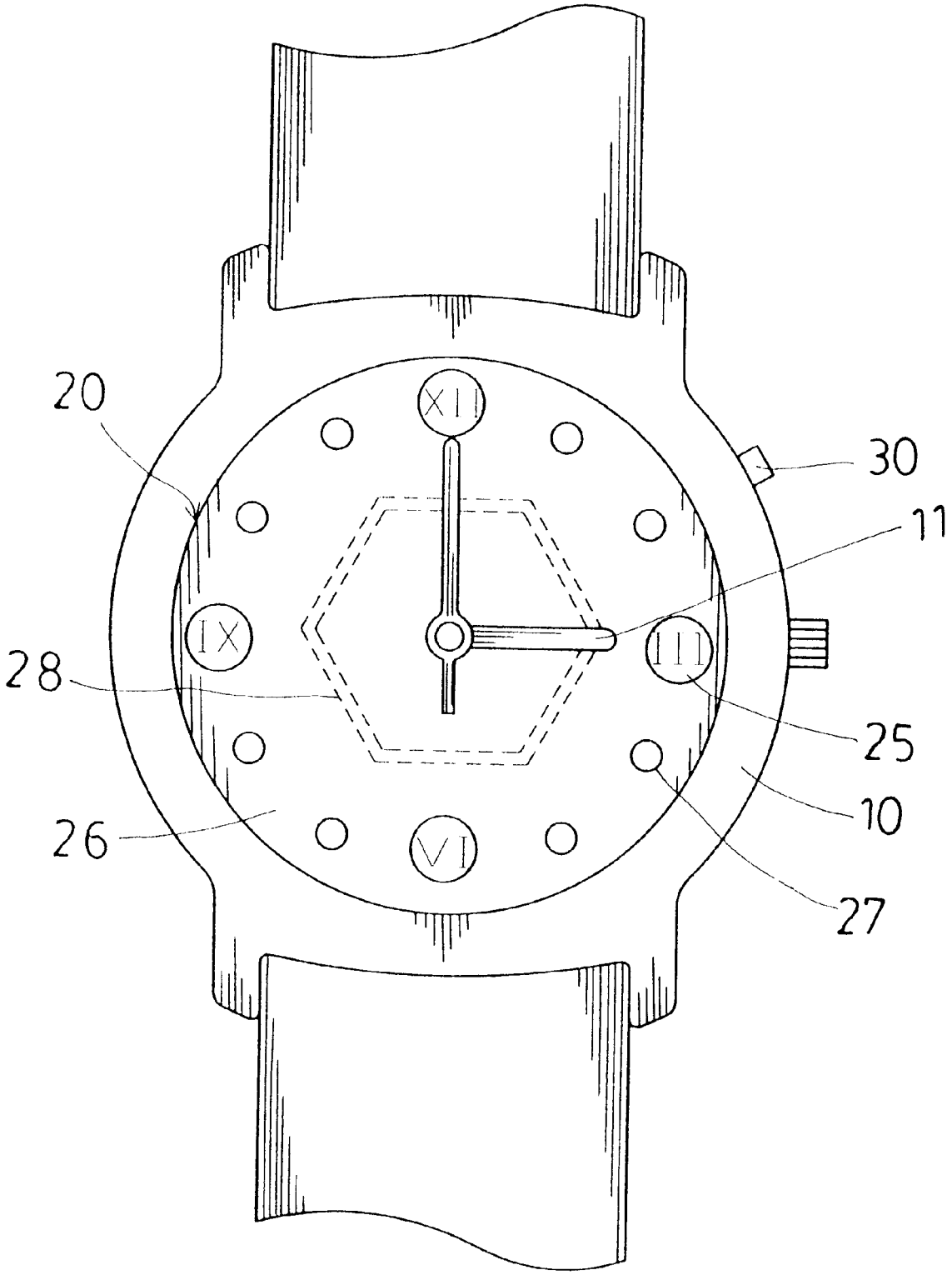
FIG. 5 is a plain view of another watch constructed according to the present invention.

The luminous body 20 comprises a first electroluminescent layer 21, a second luminescent layer 28, an insulative layer 22, a first conductive layer 23, a second conductive layer 24, and a light penetrable layer 26. As illustrated in FIGS. 1 and 2, the second electroluminescent layer 28 is an endless electroluminescent element arranged on the insulative layer 22 around its center, and the first electroluminescent layer 21 is comprised of a plurality of electroluminescent indices arranged on the insulative layer 22 around the second electroluminescent layer 28. Further, the second electroluminescent layer 28 may have any of a variety of shapes. FIGS. 4 and 5 show two examples of the second electroluminescent layer 28. After installation of the first electroluminescent layer 21 and the second electroluminescent layer 28 in the insulative layer 22, the insulative layer 22 is sandwiched in between the first conductive layer 23 and the second conductive layer 24. The first conductive layer 23 and the second conductive layer 24 have a respective conductor 231;241 respectively connected to power source. When electrically connected, the first electroluminescent layer 21 and the second electroluminescent layer 28 are energized by electricity to produce light. Because the first electroluminescent layer 21 and the second electroluminescent layer 28 cover only a part of the insulative layer 22, less electric energy is consumed during working of the luminous body 20. Further, dark color or black color marks 25 may be made on the electroluminescent indices of the first electroluminescent layer 21. The marks 25 can be hour numerals/chapters or the like (see FIGS. 4 and 5). The light penetrable layer 26 is covered on one side, namely, the top side of the first conductive layer 23 opposite to the insulative layer 22 (the other side, namely, the bottom side of the first conductive layer 23 is closely attached to the insulative layer 22. The light penetrable layer 26 comprises a plurality of raised portions 27 corresponding to the electroluminescent indices of the first electroluminescent layer 21. The raised portions 27 refract light from the first electroluminescent layer 21 and the second electroluminescent layer 28. Alternatively, dark color or black color marks 25 may be made on the raised portions 27 at the light penetrable layer 26.

When the switch 30 is switched on, the first electroluminescent layer 21 and the second electroluminescent layer 28 are energized to produce light, and light from the first electroluminescent layer 21 illuminate the marks 25 and, are refracted in different directions by the curved outer surface of the raised portions 27. When the switch 30 is switched off, electricity is disconnected from the first electroluminescent layer 21 and the second electroluminescent layer 28, and therefore the first electroluminescent layer 21 and the second electroluminescent layer 28 are off.

The second electroluminescent layer 28 and the electroluminescent indices of the first electroluminescent layer 21 may be colored with different colors. For example, the electroluminescent indices corresponding to even hour numerals are colored with a first color, and the electroluminescent indices corresponding to odd hour numerals are colored with a second color; the electroluminescent indices corresponding to hour numerals 3, 6, 9 and 12 are colored with one color, and the other electroluminescent indices are colored with another color.

As indicated above, the invention achieves the following advantages:

1. Because the electroluminescent layers 21 and 28 cover only hour numerals area and center area of the insulative layer 22, the luminous body 20 consumes less electric energy during its operation.
2. The raised portions 27 of the light penetrable layer 26 refract light from the first electroluminescent layer 21 in different directions, enabling the user to see the time indication of the watch 10 clearly in the dark.

3. A multi-contact switching circuit means may be installed to control the illumination of the electroluminescent indices of the first electroluminescent layer 21 and the second electroluminescent layer 28 respectively.

4. Marks 25 at the raised portions 27 or the first conductive layer 23 are well illuminated by light from the first electroluminescent layer 21 for hour numeral indication.

What is claimed is:

1. A luminous body mounted in a watch below hands and a protective crystal and controlled by a switch at said watch to produce light, comprising:

a first conductive layer, said first conductive layer being transparent, and having a conductor connected to power source;

a second conductive layer, said second conductive layer having a conductor connected to power source;

an insulative layer sandwiched in between said first conductive layer and said second conductive layer;

electroluminescent means arranged on said insulative layer for producing light upon electric connection of electricity to said first conductive layer and said second conductive layer, said electroluminescent means comprising an electroluminescent layer formed of a plurality of electroluminescent indices respectively arranged on said insulative layer around the border area of said insulative layer;

a plurality of marks disposed corresponding to the electroluminescent indices of said electroluminescent layer for time indication by the hands of the watch;

a light penetrable layer covered on one side of said first conductive layer opposite to said insulative layer and said second conductive layer, said light penetrable layer comprising a plurality of raised portions disposed at locations corresponding the electroluminescent indices of the electroluminescent layer of said electroluminescent means for refracting light.

2. The luminous body of claim 1 wherein the electroluminescent indices of said electroluminescent layer are colored with different colors.

3. The luminous body of claim 1 wherein said marks are hour numerals of Arabic numerals.

4. The luminous body of claim 1 wherein said marks are chapters of Roman numerals.

5. The luminous body of claim 1 wherein said marks are respectively covered on the electroluminescent indices of said electroluminescent layer.

6. The luminous body of claim 1 wherein said marks are respectively made on said first conductive layer corresponding to the electroluminescent indices of said electroluminescent layer.

7. The luminous body of claim 1 wherein said electroluminescent means further comprising a second electroluminescent layer of annular shape arranged on said insulative layer around the center area of said insulative layer.

* * * * *